United States Patent [19]

Nemeth

[11] 4,182,515

[45] Jan. 8, 1980

[54] MATHEMATICAL GAMEBOARD

[76] Inventor: Joseph J. Nemeth, 104 Providence Ave., Doylestown, Pa. 18901

[21] Appl. No.: 901,554

[22] Filed: May 1, 1978

[51] Int. Cl.[2] ..... A63F 3/00

[52] U.S. Cl. ..... 273/237; 273/138 A

[58] Field of Search ..... 273/1 E, 138 A, 237, 273/146, 236; 35/30, 31 R; 340/323 R; 235/92 GA; 364/410, 411, 717

[56] References Cited

U.S. PATENT DOCUMENTS

| | | | |
|---|---|---|---|
| 3,231,276 | 1/1966 | Cooper | 273/1 E |
| 3,460,835 | 8/1969 | Crans | 273/236 |
| 3,584,398 | 6/1971 | Meyer et al. | 273/138 A X |
| 3,587,093 | 6/1971 | Paulsen | 273/138 A |
| 3,799,553 | 3/1974 | Hurley | 273/138 A X |
| 3,825,255 | 7/1974 | Kennard et al. | 273/1 E |
| 3,825,266 | 7/1974 | Bissell | 273/237 |
| 3,844,564 | 10/1974 | Barish | 273/238 |
| 3,895,807 | 7/1975 | Friedman | 273/138 A |
| 3,902,723 | 9/1975 | Colling et al. | 273/138 A |
| 3,967,825 | 7/1976 | Anania | 273/236 |
| 4,005,867 | 2/1977 | Yaeger | 273/236 |
| 4,010,556 | 3/1977 | Ellsworth et al. | 273/138 A |
| 4,051,605 | 10/1977 | Toal et al. | 35/30 |
| 4,114,290 | 9/1978 | Cooper | 273/146 X |

*Primary Examiner*—Vance Y. Hum

*Attorney, Agent, or Firm*—James J. Cannon, Jr.; James J. Cannon

[57] ABSTRACT

A mathematical gameboard implemented electronically for use in a variety of games having elements of chance and skill. The gameboard includes a plurality of keys having numerical values embossed thereon, but whose positive or negative value is unknown to the player. A randomizing circuit determines whether the number represented by the key pressed is positive or negative, the odds of a negative value increasing as the value of the key increases. Windows are provided to display a player's score and the number of plays he has made. Electronic circuits are provided to implement the use of the gameboard.

19 Claims, 14 Drawing Figures

MATHEMATICAL GAMEBOARD

BACKGROUND OF THE INVENTION

1. Field of the Invention

This invention pertains to the field of electrical games of a mathematical nature which are chance-controlled. The game board has a plurality of keys representing various numbers, but whether the numbers have positive and negative values being randomly determined and unknown to the players. The object of the game is for each player to obtain as high a positive score as possible with a predetermined number of plays or to reach a predetermined positive score with a minimum number of plays.

2. Description of the Prior Art

There are numerous prior patents on mathematical game boards for purposes of both education and entertainment, a typical example of which is U.S. Pat. No. 3,460,835. U.S. Pat. No. 3,967,825 discloses a mechanical educational game having a random number selector. U.S. Pat. No. 3,844,564 teaches an educational game related to computers having an electronic game board and using a pair of dice as a random number selector. U.S. Pat. No. 3,825,266 discloses an electronic game apparatus using switching circuits. U.S. Pat. No. 3,799,553 also discloses a game using an electrical switch matrix. U.S. Pat. No. 3,902,723 discloses an electronic board game having random means for interference with play. U.S. Pat. No. 4,005,867 discloses a card and board game, the cards having numbers thereon, but not marked as to positive or negative value.

The closest prior U.S. Patent to the invention is U.S. Pat. No. 3,825,255 which discloses a number guessing game device. In this electronic apparatus the object of the game is to find a hidden or random number generated by the machine. This game includes a keyboard entry unit whereby players may select a number in search of the hidden random number, which selected number will be displayed. A test command compares the selected number with the hidden random number. An exact comparison produces a win. Should the selected number be higher or lower than the hidden random number, this relationship is indicated to the player who may select again. The game ends when an exact comparison is reached.

The game of the present invention, as described hereinafter, differs from this prior art game in numerous aspect. It is simpler in concept, more interesting to play, more compact in size, less expensive to manufacture and offers more embodiments both physically and conceptually.

It is an object of the present invention to provide a game with an electronic circuit offering the players options for a plurality of play selections, the outcome of which is randomly determined, thus introducing a high element of chance and interest into the game.

SUMMARY OF THE INVENTION

This invention pertains to a mathematical game for one or more players which can be implemented mechanically, electromechanically or electronically in various ways. It can also be played in various ways. The preferred embodiment and one alternate embodiment will be presented in this specification.

In the preferred embodiment the game includes as a game board a keyboard-type nine-by-nine matrix of keys, each key having a numerical value whose polarity is unknown to the player. The central key represents the number fifty and is always positive in value. The remaining eighty keys are arranged in square frames around the central key. Proceeding from innermost to outermost frames, the keys increase in numerical value in each succeeding frame. The first frame has eight keys each having the numerical value of one hundred. The second frame has sixteen keys, each having the numercial value of two hundred. The third frame has twenty four keys, each having the numerical value five hundred. The fourth, outermost frame has thirty-two keys each having the numerical value of one thousand. Except for the central key, what is unknown to the player is whether the numerical values of the keys are positive or negative. The central key is always positive. In the first frame, the one hundred series, one out of eight keys will have a negative value. In the second frame, the two hundred series, three out of sixteen keys will have a negative value. In the third frame, the five hundred series, eight out of twenty four keys will have a negative value. In the fourth frame, the one thousand series, sixteen out of thirty-two keys will have a negative value. Thus, as a player presses higher value keys, his chances of pressing a negative key increase significantly. The game board also includes a display window in which the player's score is indicated along with its value, positive or negative. The game board further includes a dial to set the number of plays per person and a window to display the number of plays remaining to the player.

The object of the game is for a player to obtain as high a positive numerical score as possible with a preset number of plays or to obtain a pre-determined positive score in a minimum number of plays. One or more players may play. All the keys have known numerical values but, with the exception of the center button, the player does not know whether these values are positive or negative. The player does, however, know that numerical odds for pressing a higher valued key increase his odds for keying a negative number, thereyby decreasing his score. Furthermore the system is designed such that if a key is pressed twice in succession, there is no assurance that its polarity will remain the same, except for the center key. This also prevents a player from memorizing a pattern. Thus elements of ohance or risk are present in the game.

The keyboard may easily be modified to show scores and number of plays for two or more players, if desired. It can also be modified to vary the number of values used, especially in the high risk, outermost frame, which could use values from one thousand to ten thousand.

An alternate embodiment would permit only one pressing of each key, allowing the player to know how many keys remain to be played in that frame. If would also freeze the positive or negative value for that key, allowing the player to know how many possible negative valued keys remain for each frame, by means of display windows having decremented counters. In this embodiment, two players could play until all keys are depressed or they could limit themselves to a pre-set number of plays.

At the end of a game, a reset button releases all the keys and resets all counters for the next game.

In another alternate embodiment, the first embodiment presented could be substantially reduced in size and manufacturing costs by replacing the nine-by-nine matrix with five keys, one for each value.

Digital logic to implement this game is also presented. The digital logic uses a clock to drive a weighted randomizer to select the polarity of the value of the key pressed. A counter loaded with an appropriate value is utilized along with score keeper. When the counter overflows, the score keeper has been incremented or decremented by the value of the key pressed. Appropriate reset and clear circuits are utilized.

DESCRIPTION OF THE PREFERRED EMBODIMENT

Figure 1:
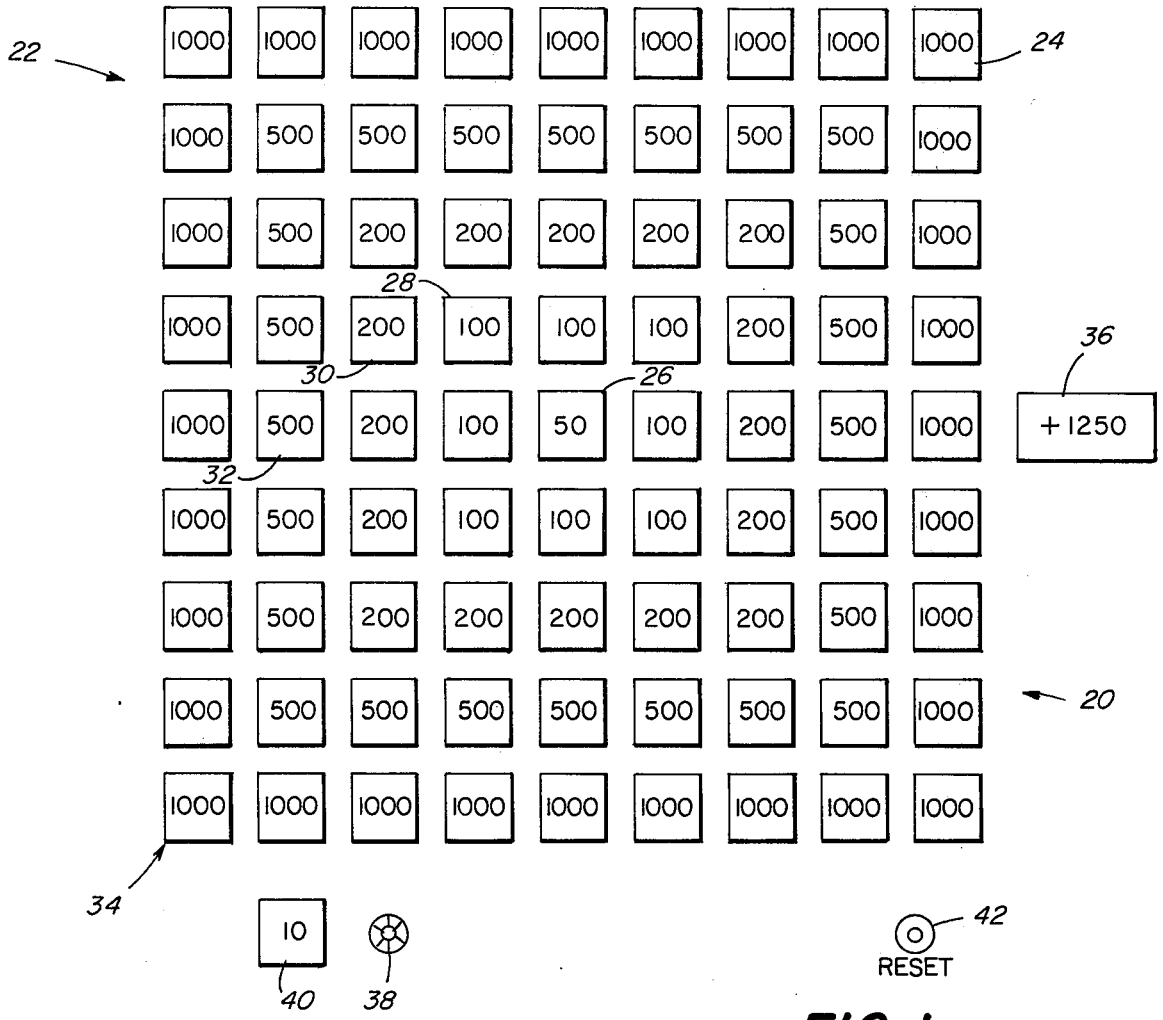
FIG. 1 is a top view of the game board of the present invention in its preferred embodiment.

Referring now to the drawings, and in particular to FIG. 1, there is shown a top view of the preferred embodiment of this invention, designated generally by the reference numeral 20. Game board 20 would normally be the upper surface of a housing, not shown, which enclosed the operational mechanisms, whether mechanical, electromechanical or electronic which make game board 20 useful for mathematical games. The preferred embodiment described hereinafter are based upon an electronic embodiment.

Game board 20 is useful for mathematical games of chance involving one or more players. In the preferred embodiment of FIG. 1, game board 20 includes a nine-by-nine matrix 22 of keys 24, each having a number embossed thereon. In this embodiment all keys 24 are really key switches electrically connected to the circuit of FIG. 4. However, whether the value of the number is positive or negative is not known to the player. The central key 26, having the numerical value fifty, is always positive in value. The remaining eighty keys 24 are arranged in square frames about central key 26. Proceeding from the innermost to the outmost frame, the first frame has eight keys 24, each having the numerical value of one hundred. The second frame 30 has sixteen keys 24, each having the numerical value two hundred. The third frame 32 has twenty-four keys 24, each having the numerical value five hundred. The fourth and outermost frame 34 has thirty-two keys 24, each having the numerical value of one thousand.

Except for the central key 26, which has a positive value of fifty, the player does not know whether the numerical values indicated on the keys 24 are positive or negative. To add elements of both interest and chance to a game using game board 20, an electronic randomizer, schematically illustrated in FIG. 4 and described hereinafter, is utilized to assign a positive or negative value to each key 24 when it is pressed. Also, the odds for pressing a negative key 24 increase with the increased value of the key 24. In the first frame 28, the one hundred value keys, the odds are one out of eight that the key pressed will have a negative value. In the second frame 30, the two hundred value keys, the odds are three out of sixteen that the key pressed will have a negative value. In the third frame 32, the five hundred series, the odds are eight out of twenty-four that the key pressed will have a negative value. In the fourth frame 34, the one thousand series, the odds are sixteen out of thirty-two that the key pressed will have a negative value. These odds are determined by the randomizer illustrated in FIG. 5 and described hereinafter. The odds, of course, may be changed. Those odds stated are for illustrative purposes only. Thus, as a player presses a higher valued key 24, his odds of reaching a negative value increase. The randomizer assigns positive or negative values at each pressing of a key 24. Thus, if a player presses the same key 24 twice in succession, he has no assurance of whether its value will be positive or negative. He only knows the odds.

Game board 20 also has a window 36 in which a player's cumulative score is displayed, whether that score be positive or negative. Game board 20 also has a dial 38 to set the number of key pressings allowed to the player. Associated with the dial 38 is a display window 40 which indicates decrementally the number of key pressings remaining for the player. The displays in windows 36 and 40 could be any of a variety of commercially available electrical devices. A reset button 42 is provided to set all values at zero when a game is completed.

To illustrate a utilization of game board 20, a game may be played in which the object is to achieve the highest positive score with a predetermined number of plays. One or more players could compete, using the same game board 20 in succession, keeping track of their scores. Alternatively, a game could be played in which the objective is to reach a predetermined positive score with a minimum number of plays. Again, one or more players could compete using the same game board 20 in succession, keeping track of their scores.

Figure 7:
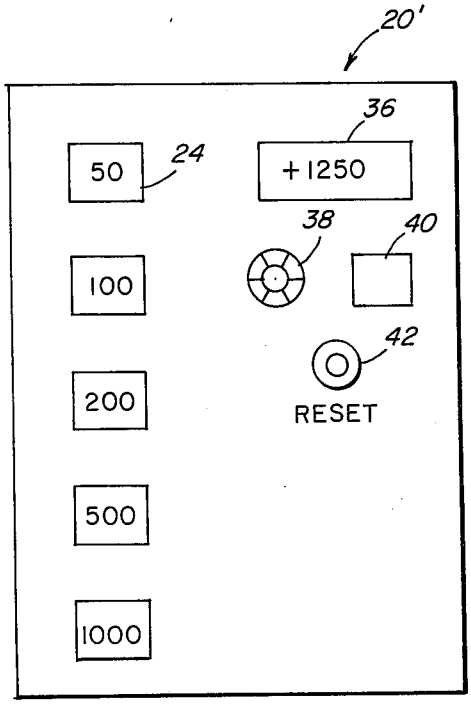
FIG. 7 is a top view of a minimum key game board for the embodiment of FIG. 1.

Game board 20 as illustrated in FIGS. 1 and 7 is a solitary game board. One or more players could compete against each other simultaneously if each player has his own game board, or with one game board if they take turns after each player has finished his series of plays for his maximum score.

Figure 2:
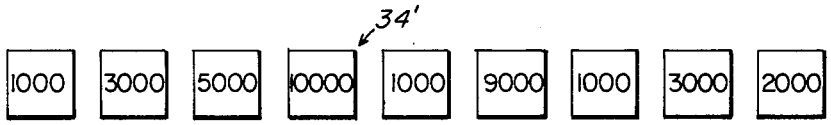
FIG. 2 shows alternate values which may be utilized in the outermost frame of the game board of FIG. 1.

The gameboard can also be altered to change the numerical values of the keys 24. In FIG. 2 an alternative variation for the outermost frame 34 is illustrated.

Figure 3:
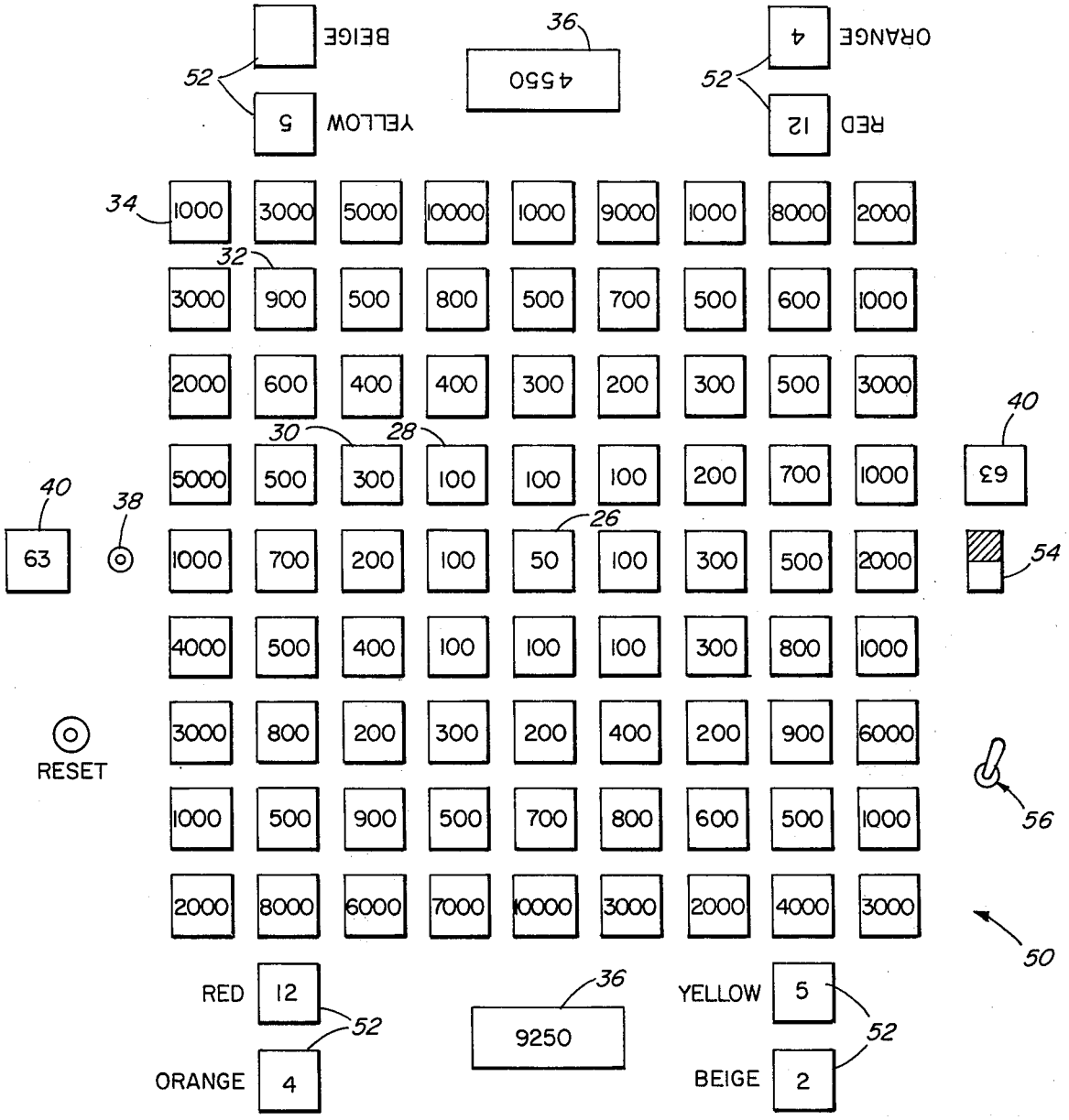
FIG. 3 shows an alternate embodiment of the game board of FIG. 1.

FIG. 3 is presented to illustrate a number of features, some or all of which may be incorporated into the gameboard of this invention. Each such feature requires modification to the block diagram of FIG. 4 and the circuit of FIG. 5. These modifications are obvious to one skilled in the art and some are illustrated in FIGS. 8 through 12.

An alternate embodiment, gameboard 50, is fully illustrated in FIG. 3. In this embodiment, each key 24 may be pressed only once, except key 26, value 50, which never remains depressed, at which time the odds of its value being positive or negative are frozen, thus allowing the player to know how many possible negative valued keys remain in that particular frame. This information is presented in windows 52, one for each frame, again the values being decremented as the odds of pressing a negative key 24 decrease.

FIG. 3 also illustrates some possible alternative features for other embodiments. A second score window 36 may be provided for ease of use in a two player game. A second number of plays window 40 may be provided. A switch 56 may be provided to indicate which player is using the board so that his score will be correctly computed. If one player is using a two-player gameboard, this switch disables the second player logic. These alternate features may also be used with the embodiment of FIG. 1, with appropriate, obvious changes in the electronic circuits. Alternatively, if only one score window 36 and number of plays window 40 are utilized, component 54 may be a sliding switch to indicate which of two players is using gameboard 50 and switch 56 would not be required.

Figure 9:
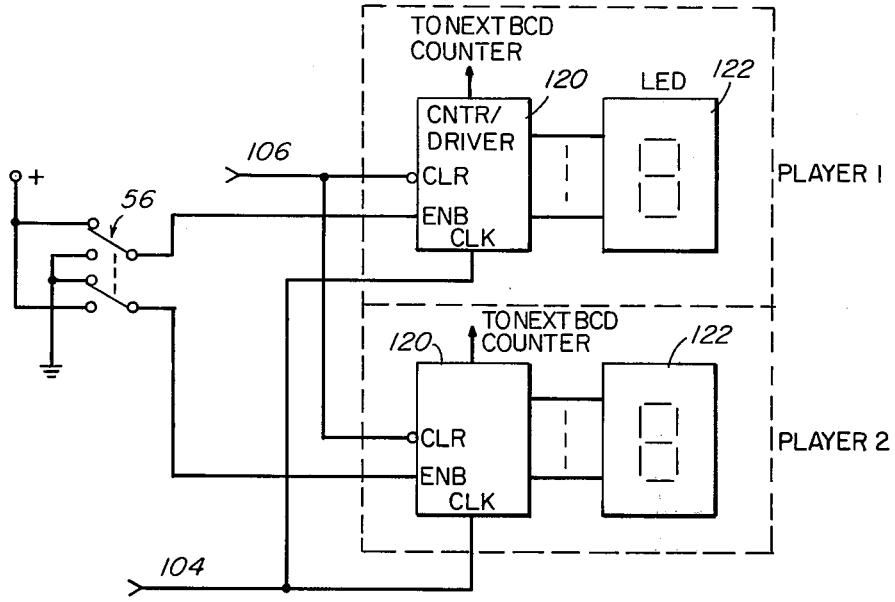
FIG. 9 is a circuit for an alternate manual switching embodiment for two players.
Figure 10:
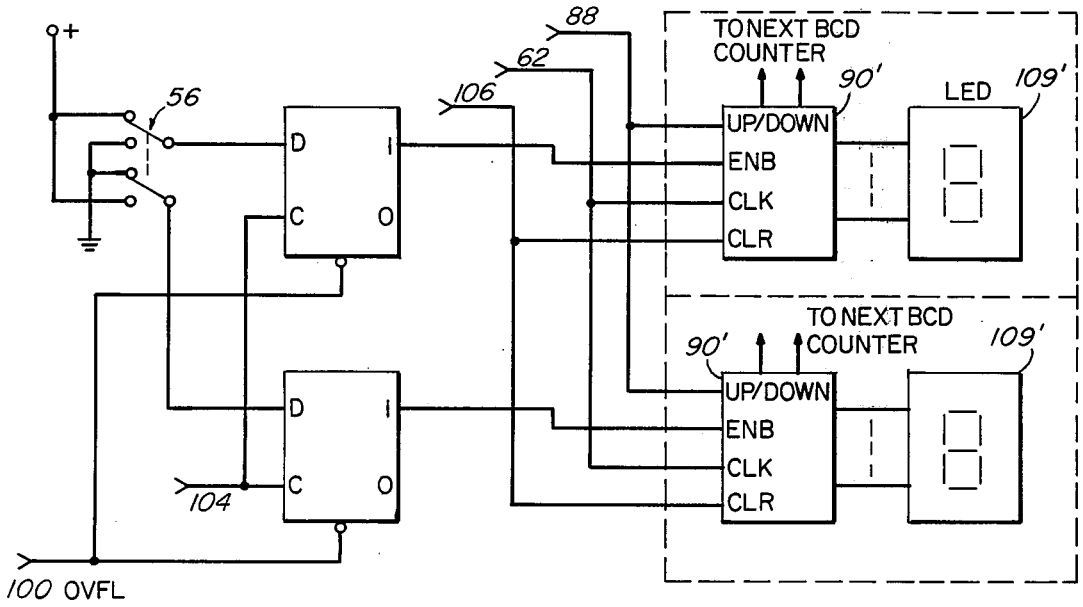
FIG. 10 is a circuit for the score keeping embodiment of FIG. 9.

A single number of plays window 40 may be switched manually using switch 56 as a select switch using the circuit of FIG. 9. A single scorekeeping window 36 would alternate between players depending on the position of switch 56, as illustrated in the circuit of FIG. 10.

Figure 12:
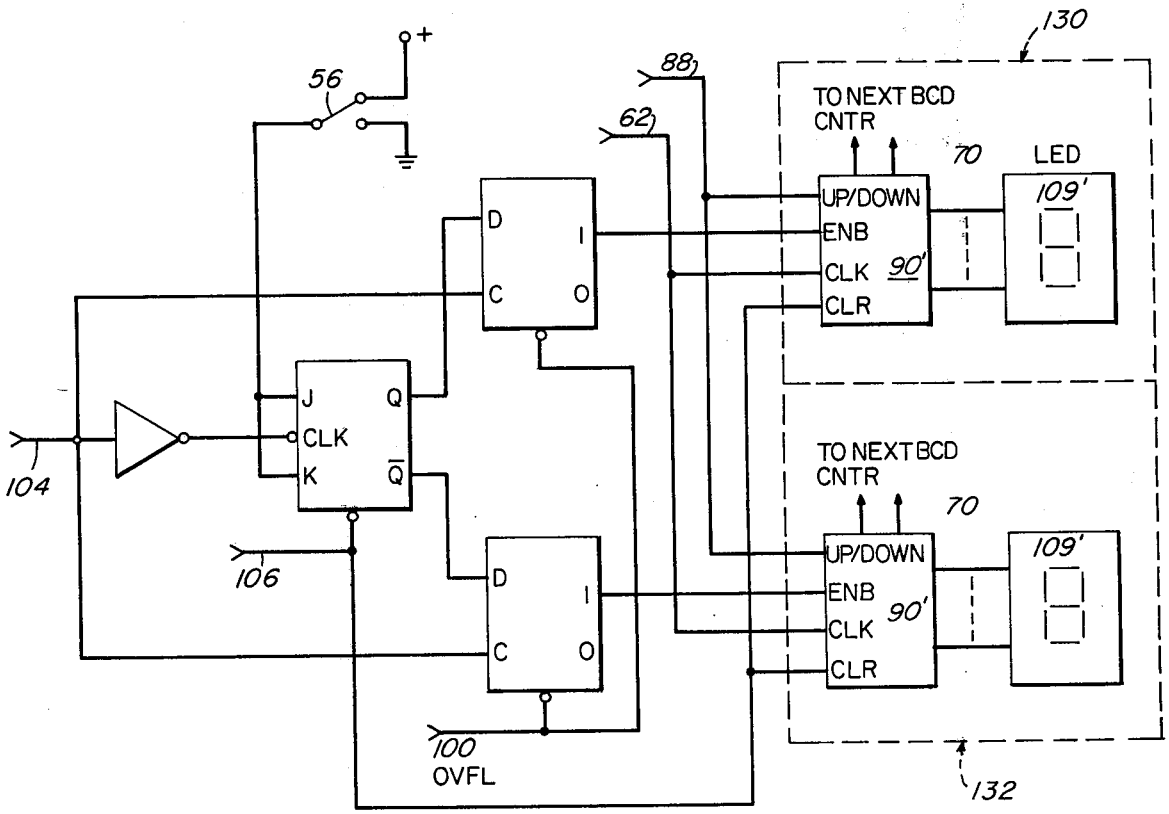
FIG. 12 is a circuit providing an alternate automatic switching embodiment for scorekeeping for the embodiment of FIG. 11.
Figure 11:
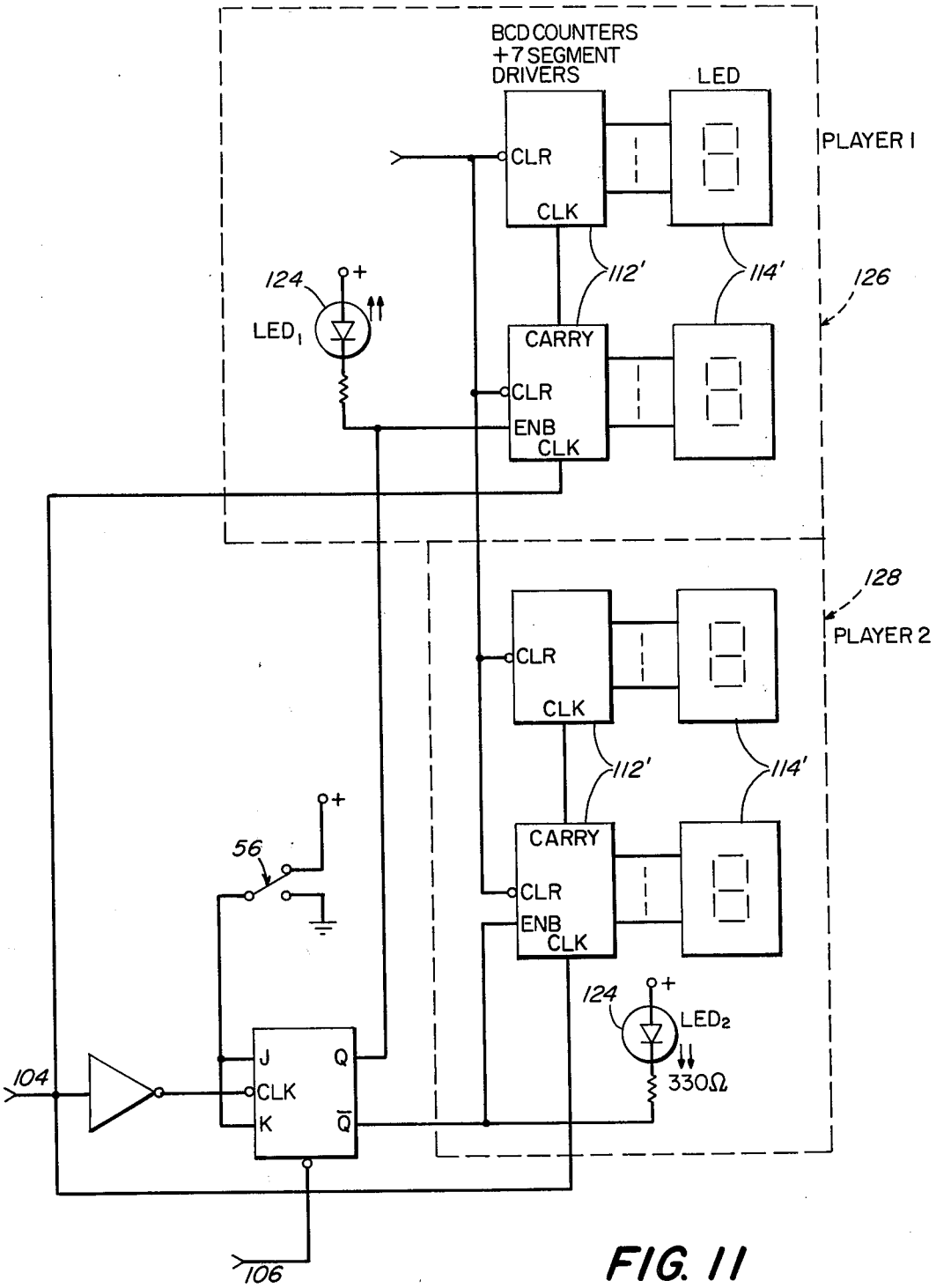
FIG. 11 is a circuit providing an alternate automatic switching embodiment for a two player embodiment.

If an embodiment utilizing two scorekeeping windows 36 and two number of play windows 40 is desired, these can be implemented using the circuits of FIGS. 12 and 11 respectively.

Other modifications would also appear obvious to one skilled in the art and would of course depend on manufacturing cost.

Figure 4A:
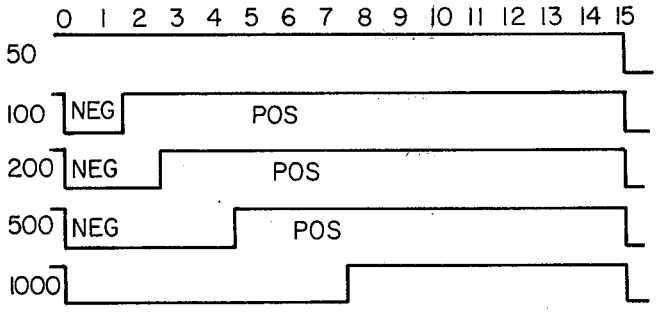
FIG. 4*a* shows the wave form outputs from the weighted randomizer of FIG. 4.
Figure 4B:
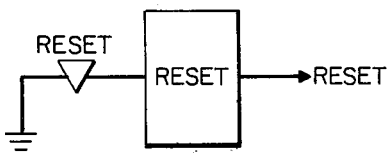
FIG. 4*b* is a block diagram of the reset circuit.
Figure 4:
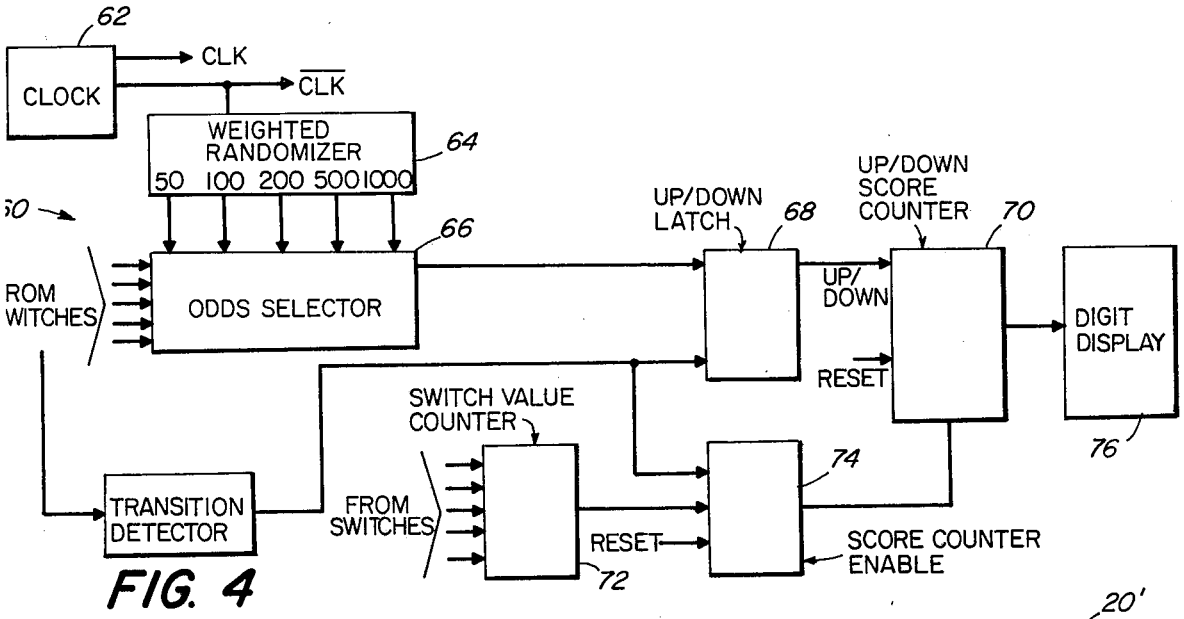
FIG. 4 is a block diagram of the electronic circuit used to implement the game board of FIG. 1.

Referring now to FIG. 4, which is a block diagram illustrating the electronic circuits required to implement the embodiments of FIGS. 1 and 7, the circuit must perform certain functions. First, it has to recognize the numerical value represented by the key 24 the player has pushed. Then, the circuit has to ascertain whether the numerical value will be positive or negative for this key depression, based on some weighted random value. Then, every time a key is depressed, the circuit must add its positive or negative value to a counter and a display unit. When the game is over, the system must have a reset means to turn the counter and the display back to zero.

FIG. 4, as stated previously, is a block diagram of a basic circuit 60 which accomplishes these functions for the embodiments illustrated in FIGS. 1 and 7. Modifications to this circuit to accomodate a different number of numerical values for the keys and different odds or weights should be obvious to one skilled in the art. Circuit 60 is basically driven by a clock 62 of approximately ten hertz. When a key 24 is depressed, its signal is received as an input to odds selector 66. The weighted randomizer 64 selects a particular state from a series of states that are constantly cycling. These states are weighted according to the odds associated with the particular numerical value in the odds selector 66. Clock 62 is driving weighted randomizer 64, and FIG. 4A shows the wave forms which output from the weighted randomizer 64 for the various numerical values used in the preferred embodiment of FIGS. 1 and 7. As shown in FIG. 4A there are sixteen possible time states and in each of those sixteen time states a signal will be high or low, corresponding to a positive or negative number at any particular time. The wave forms of FIG. 4A represent the odds for central key 26, and the keys in frames 28, 30 and 34 specified above in the discussion of FIG. 1.

When a particular key switch 24 is depressed, circuit 60 selects, through odds selector 66 and weighted randomizer 64, which of the wave forms it will apply to a latch 68. The latch 68 determines whether the score counter 70 will count up or down. At this time, circuit 60 has determined whether the number will be positive or negative and appropriately weighted.

Circuit 60 then determines the numerical value of the key 24 which has been pressed. Inputs from keys 24 are received at a switch value counter 72. An appropriate value is preloaded into switch value counter 72. As long as switch value counter 72 is counting, the up/down score counter 70 will also count. There is a one-to-one correspondence here. When the switch value counter 72 overflows, the score counter 70 is disabled by the score counter enable 74. When the score counter 70 stops, its value is displayed in the digital display 76.

FIG. 4 b shows the reset circuit which is used at the end of a game to reset all variable counters and displays to zero.

Figure 5:
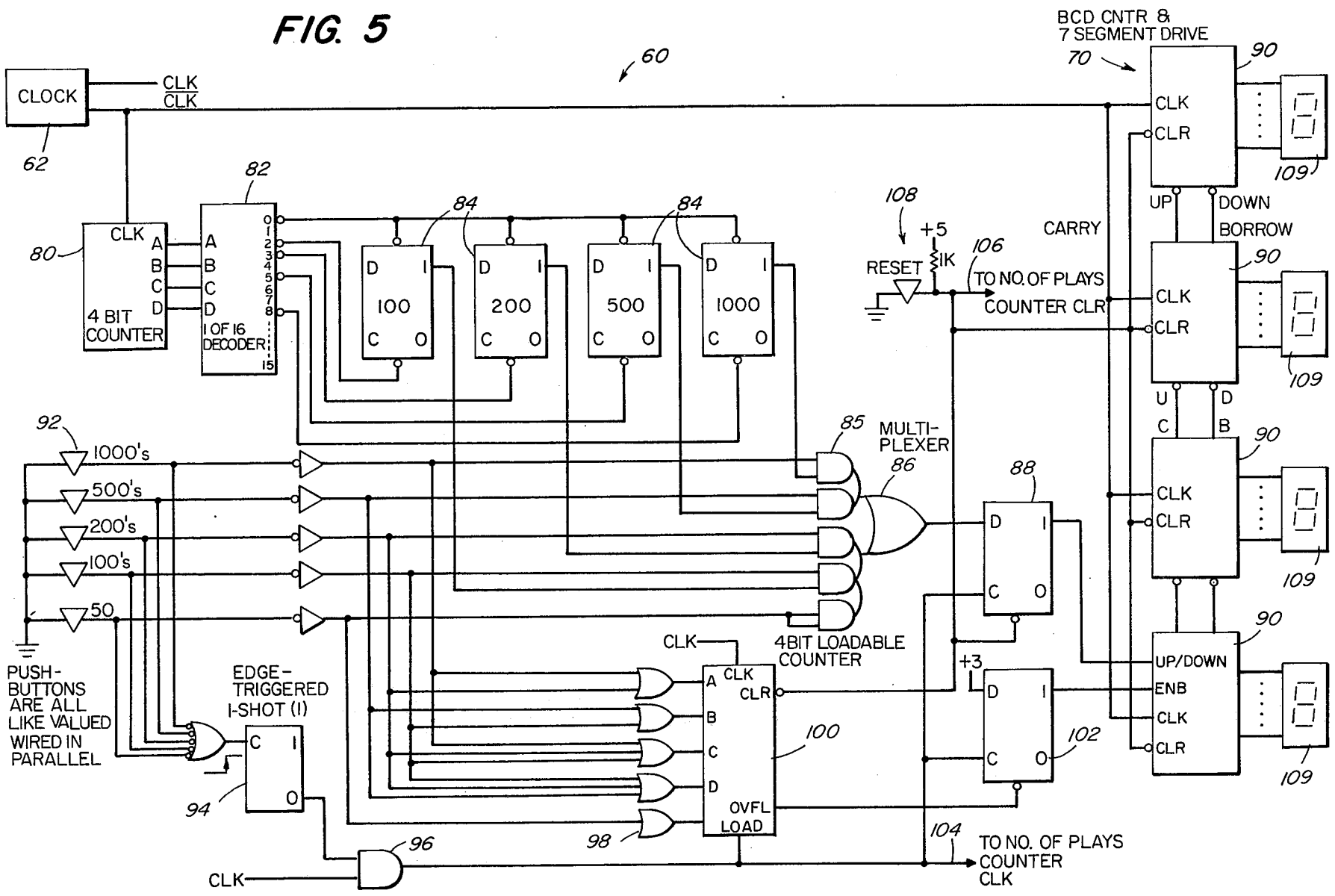
FIG. 5 is a schematic diagram of the basic circuit used in the block diagram of FIG. 4.

FIG. 5 is a schematic diagram of circuit 60. Clock 62 is a two phase clock, having a standard and an inverted phase. Clock 62 drives a four-bit standard binary counter 80. The outputs of binary counter 80 are applied to a one-of-sixteen binary decoder 82 which yields the sixteen time states described above and which are used for generating the weighted randomized values. There are four flip flops 84, each of which is associated with a particular key switch 24 value. Flip flops 84 have as their state the polarity of the value of the key 24 depressed, that is, whether the numerical value of the keys 24 will be positive or negative and whether the score counter 70 will be incremented or decremented.

When the one-of-sixteen decoder 82 creates a zero, all the flip flops 84 are caused to be set, and each of flip flops 84 will be reset by one of the other values of the one-of-sixteen decoder 82, generating the eight periodic time signals. Each of the outputs of flip flops 84 is brought into a multiplexer gate 85. The other inputs to multiplexer 86 come through the key switches 24, as described hereinafter. Thus, multiplexer 86 allows circuit 60 to select the output of the appropriate flip flop 84 for the appropriate key switch 24. Thus, the system has the correct odds for that switch 24. The output of multiplexer 86 is applied to flip flop 88, which is a latch. The latch is necessary because the states of flip flops 84 can change while the system is in the process of counting up or down. It enables the system to seize the states of flip flops 84 at a moment in time, load them into latch flip flop 88 and hold them there while the score counter 70 is counting up or down.

Score counter 70 is shown in FIG. 5 as four BCD counters 90 which are all up/down counters. The least significant digit is shown at the bottom and the most significant digit at the top. Additional counters may be used if desired. The output of latch flip flop 88 is tied to a pin on the counters 90. If the output is high, the counter 90 will count up. If the output is low, the counter 90 will count down.

The numerical value by which circuit 60 will increment or decrement counters 90 is determined as follows.

Five switches 92 are shown, for each of the numerical values of FIG. 1, which actually represent all of the individual key switches 24 having the same numerical value wired in parallel, the embodiment of FIG. 1. As shown in FIG. 5 and FIG. 7, the game board would function identically if it has only five keys 24, one for each switch 92. Circuit 60 would work for either embodiment. Any time a key 24 is pushed, circuit 60 first detects that it has been pushed. To do this all of switches 92 go into an edge triggered one-shot 94. Thus, when a key 24 is pushed, its switch 92 will activate one-shot 94. This output also feeds into multiplexer 86, as indicated in FIG. 5 which shows what transitions will occur. The output of one-shot 94 is then "anded" through "and" gate 96 with the clock 62 so that the asynchronous event of pushing a key 24 becomes synchronized with the clock 62 of circuit 60, insuring a proper sequence of events. The output signal of gate 96 causes all the other events in the system to occur.

The values of the five individual switches 92 are brought into a network of or-gates 98. These or-gates 98 develop a value which will be preloaded into a counter 100. The number that is pre-loaded into a counter 100 is representative of the numerical value of key 24 which has been pushed, and is indicative of how many counts the score counter 70 will be incremented or decremented. When any given key 24 is depressed and its switch 92 activated, the value generated by gates 98 will be loaded into counter 100, the edge triggered one-shot 94 and gate 96 will cause that loading to occur. At the same time they will cause flip flop 102 to be clocked and consequently set. This allows the enabling of score counter 70 for each of its BCD counters 90. When BCD counters 90 are clocked, they will begin to count, up or down depending on the value that was just loaded into latch flip flop 88, which was also clocked by the output of gate 96, loading in the value of multiplexer 86. When counter 100 reaches overflow, the overflow signal will be used to clear flip flop 102, which will then cause BCD counters 90 to stop counting. Thus, there is a one-to-one correspondence between counting on counter 100 and on the score counter 70.

The digits in BCD counters 90 are then displayed in display units 109 of digit display 76 which appears in window 36 of FIGS. 1 and 7.

There is also an output to number of plays counter clock, at output 104 and at output 106 from the reset circuit 106.

Figure 6:
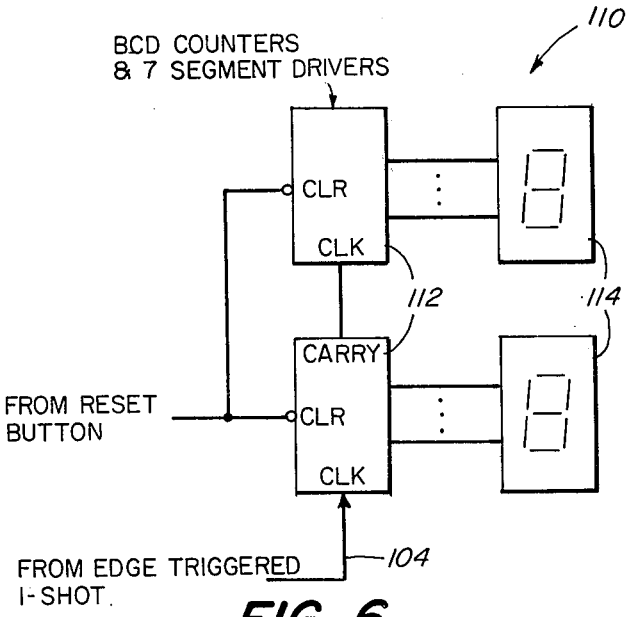
FIG. 6 is a schematic diagram of the reset and play counting circuits of FIG. 3.

FIG. 6 is a schematic diagram of circuit 110 which counts the number of key pressings which have occurred. Circuit 110 is essentially two BCD counters 112 which can have either of two inputs. If a predetermined number of plays has been selected by dial 38, that number is preloaded and counters 112 are successively decremented by input signal 104. If no predetermined number of plays has been selected by dial 38, counters 112 are successively incremented by input signal 104. At the end of a counting sequence, the information in counters 112 is displayed in display units 114, which appear in window 40 of FIGS. 1 and 7.

FIG. 7 is an alternative embodiment of game board 20', using only five keys 24, one for each of the numerical values. It includes display window 36, dial 38, display window 40 and reset button 42. It also uses the electronics presented in FIGS. 4 through 6 inclusive.

Referring back to FIG. 3, duplicate score counters 36 and number of play displays 40 are achieved by simple modifications to the circuits of FIGS. 4 through 6, inclusive, as illustrated in FIGS. 8 through 12.

Figure 8:
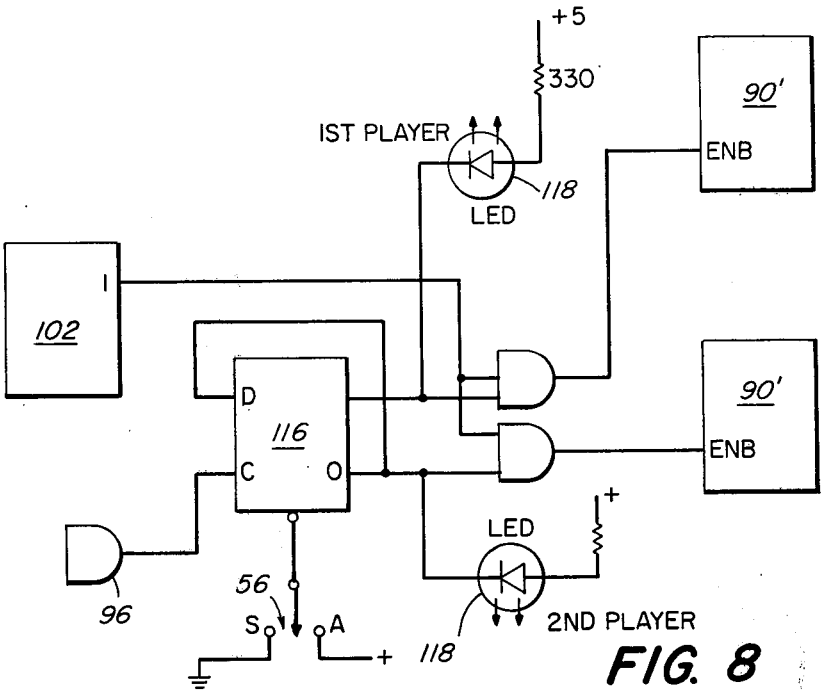
FIG. 8 is a schematic diagram of the circuit of FIG. 5 modified for a two-player game board.

In FIG. 8, redundant BCD counters 90' feed redundant displays (not shown). A flip flop 116 is added between logic 96, 102, and 90. Two LED displays 118 indicate which player is active.

FIG. 9 is an alternate circuit for an embodiment using one number of plays window 40 and switch 56 as the player selector switch, the selection being manual flipping of switch 56. It utilizes one BCD counter 120 for each digit and one LED display 122 for each digit required in window 40 for each player.

FIG. 10 is an alternate score keeping circuit for the embodiment of FIG. 9 using two display windows 40 and manual switch 56 to indicate which player is active. A latch 124 is used to indicate which player is active. Redundant BCD counters 90' feed redundant LED displays 109', as in FIG. 8.

FIG. 11 provides for an alternate embodiment in which the switching from player 1 to player 2 is automatic for counting the number of plays. Optional LED displays 124 indicate which player is playing. That portion of the circuit designated as 126 within dotted lines is for a gameboard 20' having one number of plays window 40. In a two player embodiment using one number of plays window 40, removing that portion of the circuits designated 128 will result in the number of plays being decremented once every two plays. That portion of the circuit designated 128 is for a gameboard 20' having two numbers of play windows 40. In this option switch 56 disables circuit portion 128 for one player use of gameboard 20'.

FIG. 12 provides for an alternate embodiment in which the switching from player 1 to player 2 is automatic for scorekeeping.

That portion of the circuit designated 130 is for player 1 and that portion designed 132 is for player 2. In this embodiment switch 56 disables the counter and display for one player use of the gameboard 20'.

The present invention provides for a circuit that can be employed with an electronic game. The circuit of this invention is simple in design, is economical to produce and is reliable so as to avoid costly maintenance and repair. The invention in its broader aspects is not limited to the specific details shown and described and departures may be made from such details shown and described without departing from the principles of the invention and without sacrificing its chief advantages.

The invention has been described herein by reference to certain preferred embodiments. However, as obvious variations thereon will become apparent to those skilled in the art, the invention is not to be considered as limited thereto.

I claim:

1. A gameboard for use in mathematical games of chance comprising:

a playing surface;

a plurality of depressable keys on said playing surface, each of said keys having a numerical value embosses thereon;

means responsive to said keys for generating a signal;

weighted randomizing means for receiving said signals from said depressed keys and for randomly assigning a positive or negative value thereto as a function of the numerical value;

means to determine and display the cumulative values of the keys depressed by a player using said gameboard;

means to reset said gameboard at the conclusion of a game.

2. The gameboard of claim 1 further comprising:

means to count and display the number of keys a player has depressed during a game.

3. The gameboard of claim 1 further comprising:

means to weigh the probability of a numerical value being positive or negative.

4. The gameboard of claim 1 wherein each of said keys is electrically connected to a key switch in an electrical circuit.

5. The gameboard of claim 4 wherein said means to determine whether the numerical value of a depressed key includes:

a clock cycling continuously;

a multiple-bit counter driven by said clock;

a decoder fed from said counter to determine a plurality of digital states;

a plurality of flip flops which are set by each of said states for each of said numerical values;

a multiplexer which receives the states of the flip flops upon activation of a switch, thus determining the positive or negative value of the number represented by the key switch;

a latch flip flop set by the output of said multiplexer.

6. The gameboard of claim 5 wherein said gameboard further includes means to weight the probability of a numerical value being positive or negative includes setting predetermined bit configurations in said multiple bit counter.

7. The gameboard of claim 5 wherein said means to determine and display the cumulative values of the keys depressed further includes:

an edge triggered one-shot which receives an input signal from whichever key switch is activated;

an "AND" gate which receives outputs from said one-shot and said clock to synchronize said signals and to enable BCD counters;

a plurality of OR gates receiving a signal from said activated key switch;

a first counter receiving signals from said OR gates representing the numerical value of the key switch which has been activated;

a plurality of BCD counters enabled by said flip flop, receiving a positive-negative signal from said latch flip flop and a numerical value of a key switch from said first counter, said BCD counters counting until they reach the signed numerical value of the key depressed;

a digital display to display the final state of said BCD counters.

8. The gameboard of claim 1 wherein said plurality of keys is a nine-by-nine matrix.

9. The gameboard of claim 8 wherein each of said keys may be depressed only once and its signed value frozen by means for setting said signed value.

10. The gameboard of claim 9 wherein means are provided to display to the player the number of remaining unpressed keys having a negative value.

11. The gameboard of claim 1 wherein said plurality of keys is five.

12. The gameboard of claim 1 further including;

means to predetermine the number of times a player may depress a key.

13. The gameboard of claim 12 wherein said means comprises:

a dial to set the number of plays;

a circuit to record said number;

a circuit to decrement said number after each key depression; and a digital display means to display the number of plays remaining from said to preset number.

14. The gameboard of claim 1 further including:

a plurality of number of plays displays.

15. The gameboard of claim 1 further including:

a plurality of score windows.

16. The gameboard of claim 1 further including:

means to switch a number of plays display from one player to another player.

17. The gameboard of claim 1 further including:

means to switch a score display from one player to another.

18. The gameboard of claim 17 further including:

a display to indicate which player is active.

19. The gameboard of claim 1 further comprising:

means to preset at least one of said keys to a positive value.

* * * * *